US009382918B2

(12) United States Patent
Kuramochi et al.

(10) Patent No.: US 9,382,918 B2
(45) Date of Patent: Jul. 5, 2016

(54) CEILING FAN

(75) Inventors: Hiroyuki Kuramochi, Aichi (JP); Shigeo Itou, Osaka (JP); Kiyohiko Iwamoto, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 758 days.

(21) Appl. No.: 13/812,878

(22) PCT Filed: Sep. 5, 2011

(86) PCT No.: PCT/JP2011/004953

§ 371 (c)(1),
(2), (4) Date: Jan. 29, 2013

(87) PCT Pub. No.: WO2012/032755

PCT Pub. Date: Mar. 15, 2012

(65) Prior Publication Data

US 2013/0136603 A1 May 30, 2013

(30) Foreign Application Priority Data

Sep. 6, 2010 (JP) ..... 2010-198469

(51) Int. Cl.
*F04D 29/60* (2006.01)
*F04D 25/08* (2006.01)

(52) U.S. Cl.
CPC ..... *F04D 29/601* (2013.01); *F04D 25/088* (2013.01); *F24F 2221/14* (2013.01)

(58) Field of Classification Search
CPC ... F04D 25/088; F04D 29/601; F24F 2221/14
See application file for complete search history.

(56) References Cited

U.S. PATENT DOCUMENTS

| | | | | |
|---|---|---|---|---|
| 4,871,327 | A * | 10/1989 | Ridgway | F16B 35/044 403/379.3 |
| 5,429,481 | A | 7/1995 | Liu | |
| 6,311,943 | B1 * | 11/2001 | Tang | F04D 25/088 248/317 |
| 7,143,988 | B2 * | 12/2006 | Blateri | F21V 21/12 248/343 |
| 7,785,077 | B2 * | 8/2010 | Richardson | F04D 25/088 416/244 R |
| 2008/0286111 | A1 | 11/2008 | Richardson et al. | |
| 2010/0040494 | A1 | 2/2010 | Yamamoto et al. | |

FOREIGN PATENT DOCUMENTS

| | | |
|---|---|---|
| JP | 2006-306357 | 11/2006 |
| JP | 2008-121551 | 5/2008 |
| WO | 2008059665 | 5/2008 |

OTHER PUBLICATIONS

International Search Report of PCT Application No. PCT/JP2011/004953 dated Nov. 29, 2011.
English Translation of Chinese Search Report dated Mar. 2, 2015 for the related Chinese Patent Application No. 201180042713.9.

* cited by examiner

*Primary Examiner* — Christopher Verdier
*Assistant Examiner* — Adam W Brown
(74) *Attorney, Agent, or Firm* — PIPM; Kerry S. Culpepper

(57) ABSTRACT

A ceiling fan includes a suspension part, a pipe, and a main body, the main body has a coupling part, an upper portion of the coupling part has a coupling hole, a lower portion of the pipe has a pipe hole, the coupling part is inserted into the pipe, a bolt inserted into the coupling hole and the pipe hole, and a nut. The bolt includes a threaded portion and a head having a curved surface that conforms to the shape of the outer surface of the pipe. The curved surface has a head direction guide part that guides the direction of the curved surface such that the curved surface is fixed in contact with the outer surface with the nut.

9 Claims, 5 Drawing Sheets

CEILING FAN

TECHNICAL FIELD

The present invention relates to a ceiling fan.

BACKGROUND ART

A conventional ceiling fan includes a suspension part fixed to a ceiling, a pipe suspended from the suspension part, and a main body fastened to the pipe, and the pipe is fastened to the main body with a coupling bolt and a nut.

In an example, a lower surface of a head of the coupling bolt is a curved surface that conforms to an outer surface of the pipe and has a circular arc-shaped cross section (refer to, for example, PTL 1).

When fastening using such a conventional coupling bolt, only the nut needs to be rotated without fixing the coupling bolt, which is excellent in operability. However, when the coupling bolt is inserted at a wrong angle, the coupling bolt is fixed in the state where the circular arc-shaped curve surface does not conform to the outer surface of the pipe. As a result, coupling between the pipe and the main body is disadvantageously loosened during operation of the ceiling fan.

CITATION LIST

Patent Literature

PTL 1: Unexamined Japanese Patent Publication No. 2008-121551

SUMMARY OF THE INVENTION

A ceiling fan according to various embodiments includes a suspension part fixed to a ceiling, a cylindrical pipe suspended from the suspension part, and a main body coupled to the pipe. The main body has a cylindrical coupling part extending upward, an upper portion of the coupling part has a coupling hole penetrating in a horizontal direction, and a lower portion of the pipe has a pipe hole penetrating in the horizontal direction. The coupling part is inserted into the pipe such that the coupling hole communicates with the pipe hole. A bolt is inserted into the communicated coupling hole and pipe hole, and a nut is fastened to the bolt. The bolt includes a threaded portion penetrating the coupling hole and the pipe hole, and a head located at an end of the threaded portion having a curved surface that conforms to an outer surface of the pipe. The bolt includes a head direction guide part that guides the direction of the curved surface such that the curved surface is fixed in contact with the outer surface of the pipe by the nut.

With such a configuration, since the head of the bolt is inserted in a correct direction by using the head direction guide part, the bolt is not inserted at a wrong angle.

DESCRIPTION OF EMBODIMENT

An exemplary embodiment of the present invention will be described with reference to the drawings.

Exemplary Embodiment

Figure 1:
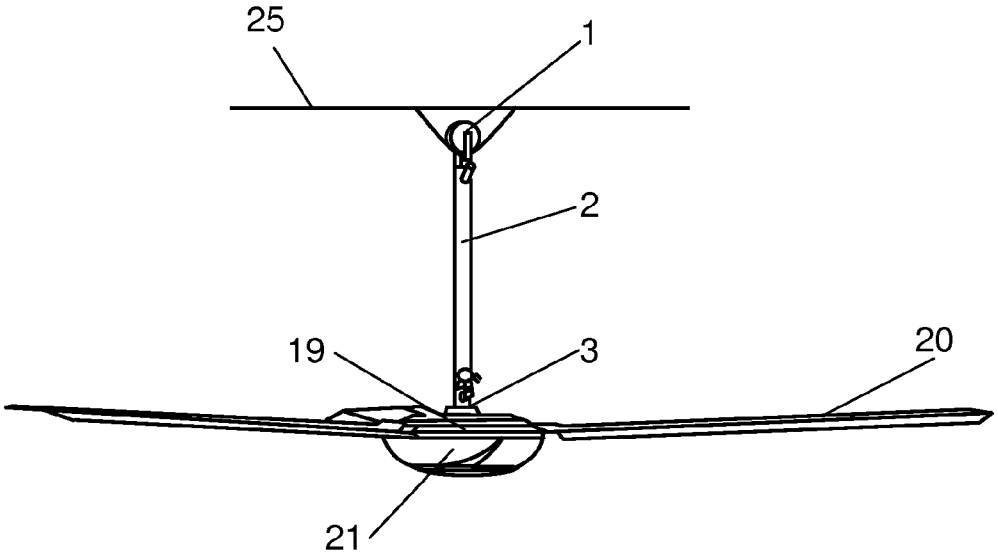
FIG. 1 is an overall view schematically showing a ceiling fan in accordance with exemplary embodiments.

FIG. 1 is an overall view schematically showing a ceiling fan in accordance with an exemplary embodiment. As shown in FIG. 1, the ceiling fan includes suspension part 1 fixed to ceiling 25, cylindrical pipe 2 suspended from suspension part 1, and main body 3 coupled to pipe 2. A circumference of main body 3 has a plurality of blades 20 extending in the horizontal direction.

Figure 2:
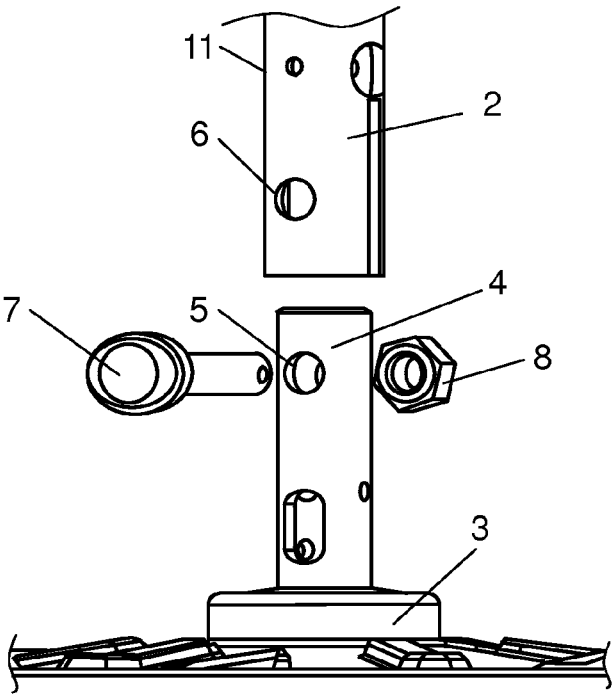
FIG. 2 is an enlarged perspective view showing the ceiling fan in accordance with an exemplary embodiment.

FIG. 2 is an enlarged perspective view showing the ceiling fan in accordance with the exemplary embodiment. As shown in FIG. 2, cylindrical coupling part 4 extending upward is provided on main body 3. Circular coupling hole 5 penetrating in the horizontal direction is provided in an upper portion of coupling part 4. Circular pipe hole 6 penetrating in the horizontal direction is provided in a lower portion of pipe 2. Coupling part 4 is inserted into pipe 2 such that coupling hole 5 communicates with pipe hole 6. In the state where coupling hole 5 communicates with pipe hole 6, bolt 7 is inserted into coupling hole 5 and pipe hole 6. Then, nut 8 is fastened to bolt 7, thereby coupling coupling part 4 to pipe 2.

Figure 3:
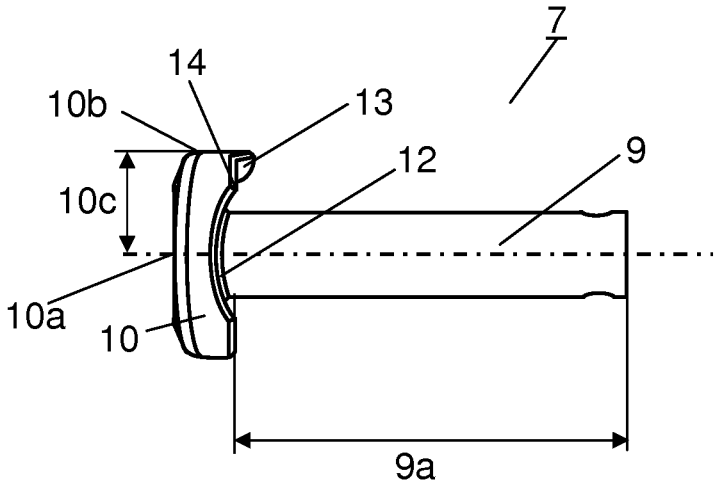
FIG. 3 is an overall view showing a bolt of the ceiling fan according to the exemplary embodiment.

FIG. 3 is an overall view showing the bolt of the ceiling fan in accordance with the exemplary embodiment. As shown in FIG. 3, bolt 7 includes threaded portion 9 and head 10. Threaded portion 9 penetrates coupling hole 5 and pipe hole 6 shown in FIG. 2. Head 10 is located at an end of threaded portion 9, and has semicircular circular arc-shaped curved surface 12 that conforms to the shape of outer surface 11 of pipe 2 shown in FIG. 2.

The ceiling fan in this exemplary embodiment has a feature that bolt 7 is fastened to nut 8 such that outer surface 11 of pipe 2 comes into contact with curved surface 12 of head 10. Then, as shown in FIG. 3, head 10 has head direction guide part 13 for guiding the direction of curved surface 12 such that curved surface 12 is fixed in contact with outer surface 11 with nut 8.

That is, in the state where coupling hole 5 communicates with pipe hole 6, bolt 7 is inserted, and only nut 8 is rotated. Then, curved surface 12 of head 10 is attached to outer surface 11 of pipe 2 in contact with each other by use of head direction guide part 13. As described above, only nut 8 is rotated, and head 10 of bolt 7 is attached to a correct position by use of head direction guide part 13.

As shown in FIG. 3, head direction guide part 13 is a protrusion extending from circular arc-shaped end 14 of circular arc-shaped curved surface 12 of head 10. Specifically, the protrusion extends in the same direction as the direction in which threaded portion 9 extends from only one circular arc-shaped end 14 of curved surface 12 of head 10.

Thus, when bolt 7 is inserted at a wrong angle, only the protrusion comes into contact with outer surface 11 of pipe 2. For this reason, contact area is small and a frictional resistance is also small. Then, head 10 is rotated by a fastening torque when fastening bolt 7 to nut 8, and the insertion angle of bolt 7 is corrected to a normal insertion angle to prevent attachment of bolt 7 at a wrong angle.

As shown in FIG. 3, the protrusion of head 10 is spherical. Thus, even when bolt 7 is inserted at a wrong angle, the spherical protrusion comes into contact with outer surface 11 of cylindrical pipe 2. For this reason, the protrusion is substantially in point-contact with pipe 2.

That is, in the state where coupling hole 5 communicates with pipe hole 6, when bolt 7 is inserted and nut 8 is rotated, a following situation occurs. Even when head 10 is not inserted at the normal insertion angle, head 10 is rotated by the fastening torque when fastening bolt 7 to nut 8, and the protrusion and pipe 2 are substantially in point-contact with each other until the insertion angle is corrected to the normal insertion angle. That is, frictional resistance is small at all times and therefore, head 10 is rotated by the fastening torque when fastening bolt 7 to nut 8 more easily. Since the insertion angle of bolt 7 is corrected to the normal insertion angle, wrong attachment of bolt 7 is prevented.

Figure 4:
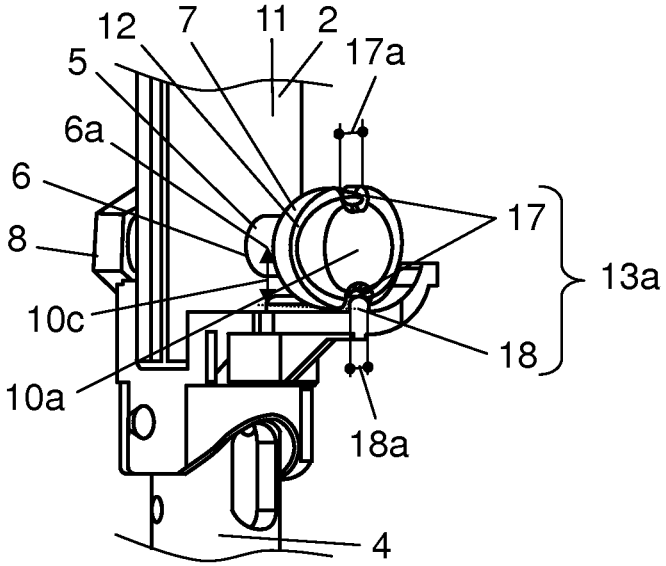
FIG. 4 is a perspective view showing a method of inserting a bolt provided with a head direction guide having a different structure according to another exemplary embodiment.

Next, head direction guide part according to another exemplary embodiment will be described. FIG. 4 is a perspective view showing a method of inserting a bolt in the ceiling fan in accordance with an exemplary embodiment in which the head direction guide part has a different structure. Head direction guide part 13*a* includes notch 17 in head 10 of the bolt 7 and guide part 18. Notch 17 is shaped like a substantially semicircle, and is provided at the center of the circular arc of curved surface 12. Guide part 18 extends from one side of pipe hole 6 in the horizontal direction. That is, guide part 18 is substantially shaped like a cylinder extending in a direction of a center axis of the circular pipe hole 6. Given that a distance from center 10*a* of the head to outer edge 10*b* of the head shown in FIG. 3 is head outer edge length 10*c*, guide part 18 is at least partially positioned within the head outer edge length 10*c* from center 6*a* of the pipe hole to engage with the notch 17.

As shown in FIG. 4, bolt 7 is inserted from the one side of pipe hole 6, on which guide part 18 is provided, into pipe hole 6 and coupling hole 5. When curved surface 12 is oriented in a direction in which outer surface 11 is fixed to curved surface 12 in contact with each other, guide part 18 passes notch 17.

At this time, bolt 7 is inserted from one side of pipe hole 6 into pipe hole 6 and coupling hole 5. Then, when bolt 7 is rotated, and notch 17 aligns with guide part 18, guide part 18 is fitted into notch 17. In this state, when nut 8 is being fastened to bolt 7, outer surface 11 comes into contact with curved surface 12. That is, bolt 7 is fastened to nut 8 in a normal attachment state, resulting in coupling part 4 and pipe 2 being coupled to each other as shown in FIG. 2. Dimension 17*a* of notch 17 is larger than dimension of outer shape 18*a* of guide part 18, and guide part 18 passes notch 17 to perform alignment of curved surface 12.

That is, by aligning notch 17 with guide part 18 and fitting guide part 18 into notch 17, the insertion angle of bolt 7 is corrected to the normal insertion angle, thereby preventing wrong attachment of bolt 7. Further, when bolt 7 is moved until curved surface 12 comes into contact with outer surface 11, rotation of bolt 7 is prevented and only nut 8 is rotated, thereby easily fastening bolt 7 to nut 8.

Notches 17 of head 10 are provided at two positions. Specifically, notches 17 are provided at two positions so as to be symmetrical about head center 10*a*. Thus, in the state where notch 17 is aligned with guide part 18, bolt 7 is vertically symmetrical. As a result, since it is not necessary to distinguish the upside from the downside, the degree of freedom in insertion of bolt 7 increases to improve the operability.

Figure 5:
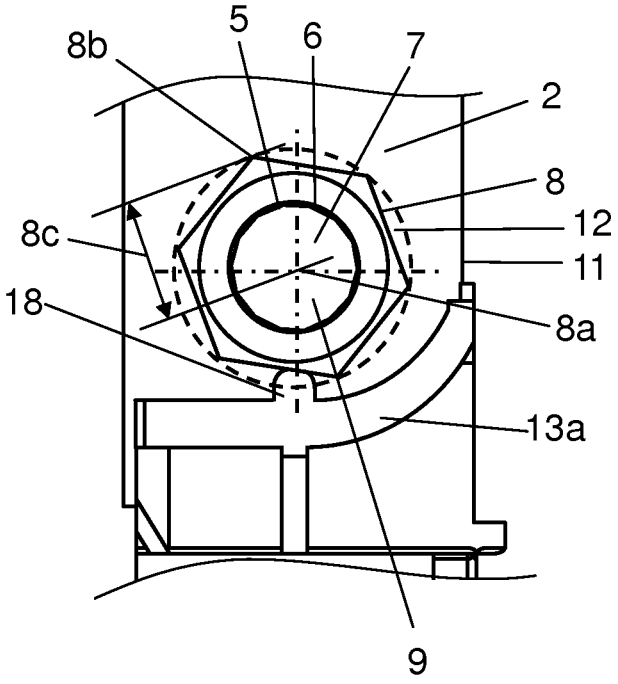
FIG. 5 is a side view showing the nut at wrong insertion of a bolt provided with the head direction guide part having the different structure in the ceiling fan.

FIG. 5 is a side view showing the nut and head direction guide part at wrong insertion of a bolt. As shown in FIG. 5, when bolt 7 is inserted into pipe hole 6 and coupling hole 5 from an incorrect side opposite to the side on which guide part 18 is provided, outer surface 11 comes into contact with curved surface 12, and nut 8 is attached to threaded portion 9. However, guide part 18 abuts against the nut 8, thereby preventing the nut 8 from being attached.

Specifically, a nut length 8*c* of the nut 8 from its center 8*a* to its outer surface 8*b* is larger than head outer edge length 10*c* as shown in FIG. 3. Thus, guide part 18 abuts against nut 8, thereby preventing the nut 8 from being attached. Accordingly, even when bolt 7 is inserted from coupling hole 5 on the opposite side to the side on which guide part 18 is provided, nut 8 cannot be fastened, thereby preventing wrong attachment of bolt 7.

Figure 6:
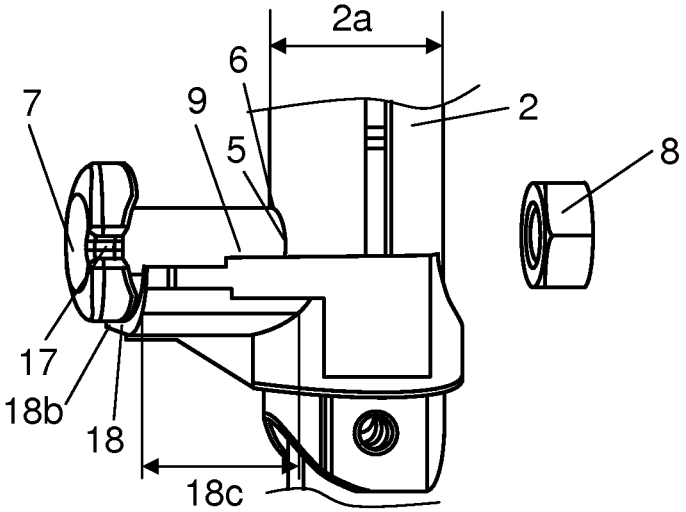
FIG. 6 is a perspective view showing a fastening part at wrong insertion of the bolt provided with the head direction guide part having the different structure in the ceiling fan.

FIG. 6 is a perspective view showing a fastening part when the bolt provided with the head direction guide part has been inserted at a wrong angle. As shown in FIG. 6, bolt 7 is inserted from one side of the pipe hole 6 into the pipe hole 6 and the coupling hole 5. However, a front end of threaded portion 9 does not protrude from pipe hole 6 until guide part 18 passes notch 17.

Specifically, threaded portion length 9*a* shown in FIG. 3 is smaller than a length obtained by adding pipe diameter 2*a* to guide part length 18*c* from outer surface 11 to guide part front end 18*b*. Thus, even when bolt 7 is inserted at a wrong angle, nut 8 cannot be fastened, thereby preventing attachment of bolt 7 at a wrong angle.

Figure 7:
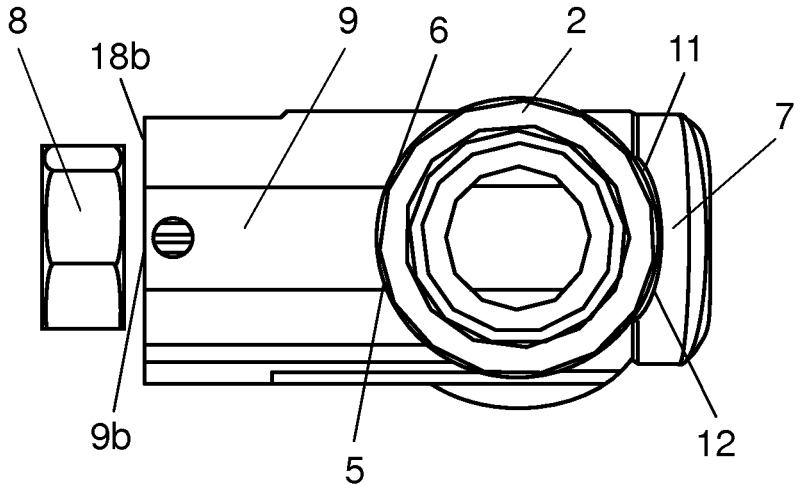
FIG. 7 is an overhead view showing the fastening part at wrong insertion of the bolt provided with the head direction guide part having the different structure in the ceiling fan.

FIG. 7 is an overhead view showing the fastening part at wrong insertion of the bolt 7 provided with the head direction guide part. As shown in FIG. 7, bolt 7 is inserted from the other side of pipe hole 6 into pipe hole 6 and coupling hole 5, and when outer surface 11 comes into contact with curved surface 12, threaded portion front end 9*b* does not protrude from guide part front end 18*b*.

Specifically, threaded portion length 9*a* is smaller than a distance from pipe hole 6 on the opposite side to guide part front end 18*b*. Thus, when bolt 17 is inserted from coupling hole 5 on the opposite side to the side on which guide part 18 is provided, nut 8 cannot be fastened due to guide part 18, thereby preventing wrong attachment of bolt 7.

Figure 8:
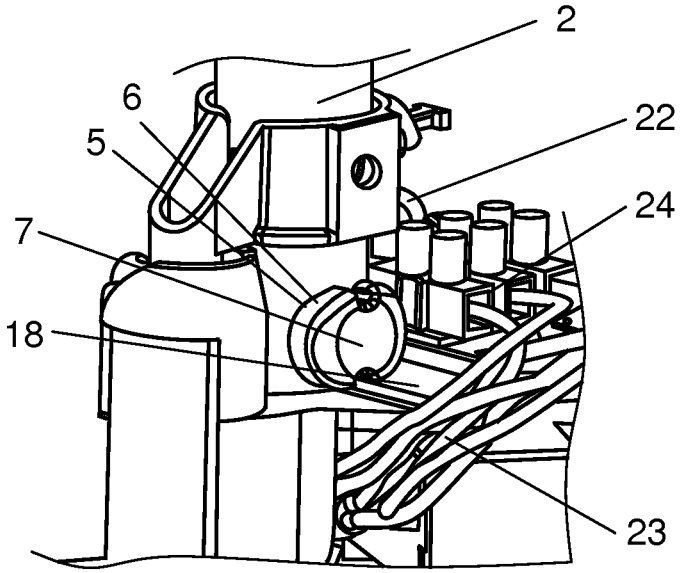
FIG. 8 is a perspective view showing the fastening portion of the ceiling fan.

FIG. 8 is a perspective view showing a fastening portion of the ceiling fan in accordance with the exemplary embodiment. As shown in FIG. 1 and FIG. 8, main body 3 includes motor 19, blades 20 rotated by motor 19, and main body case 21 that covers a lower portion of motor 19. Main body 3 is further provided with connection part 24 that is adjacent to guide part 18 and electrically connects power source wiring part 22 extending from ceiling 25 and motor wiring part 23 extending from motor 19. Connection part 24 extends from guide part 18 in a direction perpendicular to a direction in which pipe hole 6 communicates with coupling hole 5. Thus, at the operation of fastening of pipe 2 to coupling part 4 with bolt 7 and nut 8 shown in FIG. 4, connection part 24 does not become an obstacle.

As shown in FIG. 8, a direction in which power source wiring part 22 and motor wiring part 23 are electrically connected to connection part 24 is the same as the direction in which pipe hole 6 communicates with coupling hole 5. For this reason, the operation of connecting power source wiring part 22 and motor wiring part 23 to connection part 24 and the operation of fastening pipe 2 to coupling part 4 are easily performed.

Figure 9:
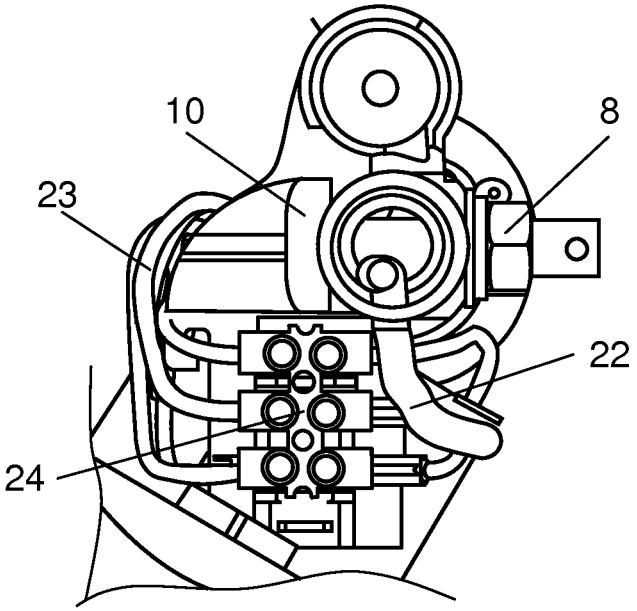
FIG. 9 is an overhead view showing the fastening portion of the ceiling fan.

FIG. 9 is an overhead view showing the fastening portion of the ceiling fan in accordance with the exemplary embodiment. As shown in FIG. 9, connection part 24 is located closer to head 10 than nut 8. Thus, since connection part 24 leans toward head 10, space on the side of nut 8 becomes large. As a result, when nut 8 is rotated by use of a tool, connection part 24 does not become obstacle for the rotation by use of the tool to improve the operability.

Although coupling part 4 is inserted into pipe 2 in the exemplary embodiment of the present invention, pipe 2 may be inserted into coupling part 4.

INDUSTRIAL APPLICABILITY

The above embodiments of a bolt, head direction guide part, pipe and coupling part can prevent wrong attachment of the bolt. Thus, the above embodiments can be applied to ceiling fans attached to a ceiling and a wall surface.

REFERENCE MARKS IN THE DRAWINGS

1 suspension part
2 pipe
2*a* pipe diameter
3 main body
4 coupling part
5 coupling hole
6 pipe hole
6*a* pipe hole center
7 bolt
8 nut
8*a* nut center
8*b* nut outer surface
8*c* nut length
9 threaded portion
9*a* threaded portion length
9*b* threaded portion front end
10 head
10*a* head center
10*b* head outer edge
10*c* head outer edge length
11 outer surface
12 curved surface
13,13*a* head direction guide part (protrusion)
14 circular arc-shaped end
17 notch
17*a* dimension of notch
18 guide part
18*a* dimension of outer shape
18*b* guide part front end
18*c* guide part length
19 motor
20 blade
21 main body case
22 power source wiring part
23 motor wiring part
24 connection part
25 ceiling

The invention claimed is:

1. A ceiling fan comprising:
a suspension part fixed to a ceiling;
a cylindrical pipe suspended from the suspension part;
a main body coupled to the cylindrical pipe, the main body including a cylindrical coupling part extending upward, an upper portion of the cylindrical coupling part having a coupling hole penetrating in a horizontal direction, a lower portion of the cylindrical pipe having a pipe hole penetrating in the horizontal direction, and the cylindrical coupling part being inserted into the cylindrical pipe such that the coupling hole communicates with the pipe hole;
a bolt inserted into the communicated coupling hole and pipe hole; and
a nut fastened to the bolt,
the bolt including a threaded portion penetrating the coupling hole and the pipe hole and a head located at an end of the threaded portion, the head having a curved surface that conforms to an outer surface of the cylindrical pipe, and the curved surface having a head direction guide part that guides a direction of the curved surface such that the curved surface is fixed in contact with the outer surface with the nut, the head direction guide part is a protrusion extending from a circular arc-shaped end of the curved surface.

2. The ceiling fan according to claim 1, wherein
the protrusion is spherical.

3. A ceiling fan comprising:
a suspension part fixed to a ceiling;
a cylindrical pipe suspended from the suspension part;
a main body coupled to the cylindrical pipe, the main body including a cylindrical coupling part extending upward, an upper portion of the cylindrical coupling part having a coupling hole penetrating in a horizontal direction, a lower portion of the cylindrical pipe having a pipe hole penetrating in the horizontal direction, and the cylindrical coupling part being inserted into the cylindrical pipe such that the coupling hole communicates with the pipe hole;
a bolt inserted into the communicated coupling hole and pipe hole; and
a nut fastened to the bolt, wherein
the bolt including a threaded portion penetrating the coupling hole and the pipe hole and a head located at an end of the threaded portion, the head having a curved surface that conforms to an outer surface of the cylindrical pipe, and the curved surface having a head direction guide part that guides a direction of the curved surface such that the curved surface is fixed in contact with the outer surface with the nut,
the head direction guide part includes a notch provided at a center of the curved surface,
a guide part extends from an outer surface of the cylindrical pipe in the horizontal direction and is positioned to be within a head outer edge length from a center of the pipe hole, the head outer edge length defined from the center of the head to an outer edge of the head, and
a dimension of the notch is set to be larger than a dimension of an outer shape of the guide part to cause the notch to pass the guide part to align the curved surface.

4. The ceiling fan according to claim 3, wherein
a nut length from the center of the nut to the outer surface of the nut is larger than a head outer edge length from the center of the head to an outer edge of the head.

5. The ceiling fan according to claim 3, wherein
the notch includes two notch portions provided at two positions that are symmetrical about the center of the head, respectively.

6. The ceiling fan according to claim 3, wherein a length of the threaded portion is smaller than a length obtained by adding a diameter of the cylindrical pipe to a length of the guide part from the outer surface to a front end of the guide part.

7. The ceiling fan according to claim 3, wherein the main body includes a motor that rotates a blade, and a connection part that is adjacent to the guide part and electrically connects a power source wiring part extending from the ceiling to a motor wiring part extending from the motor.

8. The ceiling fan according to claim 7, wherein the connection part is located closer to the head than the nut.

9. A ceiling fan comprising:

a cylindrical pipe;

a main body, one of the main body and the cylindrical pipe includes a cylindrical coupling part configured to couple the main body and the cylindrical pipe, the coupling part having a coupling hole penetrating in a horizontal direction, the other of the main body and the cylindrical pipe includes a hole penetrating in the horizontal direction, and the coupling part being inserted into the other of the main body and the cylindrical pipe such that the coupling hole communicates with the hole;

a bolt inserted into the communicated coupling hole and hole; and a nut fastened to the bolt, the bolt including a threaded portion penetrating the coupling hole and the hole and a head located at an end of the threaded portion, the head having a curved surface that conforms to an outer surface of the other of the main body and the cylindrical pipe, and the curved surface having a head direction guide part that guides a direction of the curved surface such that the curved surface is fixed in contact with the outer surface with the nut, the head direction guide part is a protrusion extending from a circular arc-shaped end of the curved surface.

* * * * *